US010480285B2

(12) United States Patent
Hansen et al.

(10) Patent No.: US 10,480,285 B2
(45) Date of Patent: Nov. 19, 2019

(54) ENERGY SAVING DOWNHOLE AND SUBSEA VALVE

(71) Applicant: HANSEN DOWNHOLE PUMP SOLUTIONS, AS, Bryne (NO)

(72) Inventors: Henning Hansen, Dolores (ES); Tarald Gudmestad, Nærbø (NO); James Lindsay, Glasgow (GB)

(73) Assignee: HANSEN DOWNHOLE PUMP SOLUTIONS, AS, Bryne (NO)

( * ) Notice: Subject to any disclaimer, the term of this patent is extended or adjusted under 35 U.S.C. 154(b) by 0 days.

(21) Appl. No.: 16/165,914

(22) Filed: Oct. 19, 2018

(65) Prior Publication Data

US 2019/0055815 A1 Feb. 21, 2019

Related U.S. Application Data

(63) Continuation of application No. PCT/IB2017/052280, filed on Apr. 20, 2017.

(60) Provisional application No. 62/328,824, filed on Apr. 28, 2016.

(51) Int. Cl.
*E21B 34/10* (2006.01)
*E21B 43/12* (2006.01)

(52) U.S. Cl.
CPC ..... *E21B 34/10* (2013.01); *E21B 43/123* (2013.01); *E21B 43/129* (2013.01)

(58) Field of Classification Search
CPC ..... E21B 34/00; E21B 34/02; E21B 34/06; E21B 34/10–108; E21B 43/12; E21B 43/129; E21B 43/123; F04B 47/00–145; F16K 17/00; F16K 17/02–0493; F16K 21/00; F15B 7/00
See application file for complete search history.

(56) References Cited

U.S. PATENT DOCUMENTS

| | | | |
|---|---|---|---|
| 5,806,598 | A | 9/1998 | Amani |
| 8,991,504 | B2 | 3/2015 | Hansen |
| 2012/0152552 | A1 | 6/2012 | Mitchell et al. |
| 2016/0032912 | A1 | 2/2016 | Klompsa et al. |

OTHER PUBLICATIONS

International Search Report and Written Opinion, International Application No. PCT/IB2017/052280 dated Aug. 3, 2017.

*Primary Examiner* — George S Gray
(74) *Attorney, Agent, or Firm* — Richard A. Fagin

(57) ABSTRACT

A method for operating a pressure operated device in a wellbore includes conducting pressurized gas to a power fluid inlet port of a valve at a first pressure. The first pressure is selected to cause a shuttle in the valve to be positioned to enable flow of the pressurized gas through the valve to a power fluid flow port in communication with a power fluid inlet of the pneumatic device. Pressure of the pressurized gas is increased to a second pressure greater than the first pressure, whereby the shuttle moves to close the power fluid inlet port to flow and to vent the power fluid flow port to ambient pressure in the wellbore.

11 Claims, 4 Drawing Sheets

ENERGY SAVING DOWNHOLE AND SUBSEA VALVE

CROSS REFERENCE TO RELATED APPLICATIONS

Continuation of International (PCT) Application No. PCT/IB2017/052280 filed on Apr. 20, 2018. Priority is claimed from U.S. Provisional Application No. 62/328,824 filed Apr. 28, 2018. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of apparatus disposed below the surface of the earth operated by pneumatic pressure. More particularly, the disclosure relates to pneumatically operated apparatus that use repeated increases and decreases in pneumatic pressure to operate.

U.S. Pat. No. 8,991,504 issued to Hansen discloses a wellbore pump for use in wellbores drilled through fluid producing formations in the subsurface. The disclosed pump is operated by repeatedly applying pneumatic pressure to a pump chamber to displace fluid in the pump chamber into a conduit extending from the wellbore pump to the surface. The pneumatic pressure is then bled off to enable fluid from a fluid producing formation to enter the wellbore and the pump chamber. Pump operation requires repeated pneumatic pressurization and bleeding of the pneumatic pressure.

A substantial amount of energy is required to pressurize a power fluid conduit extending from the surface to the wellbore pump that supplies the pneumatic pressure to operate the foregoing pump. The amount of energy required to pressurize the power fluid conduit is related to the length of the power fluid conduit. For wellbore pumps disposed at great depth in a wellbore, therefore, the energy required to operate such a pneumatically powered wellbore can be prohibitively expensive.

DETAILED DESCRIPTION

The present disclosure describes a valve assembly that may be deployed in a wellbore on a control line or power fluid line. The valve may be deployed on coiled tubing or production tubing. The valve may also be deployed using armored cable ("wireline"). A valve according to the present disclosure may provide significant cost savings to operate wellbore apparatus using increases and decrease in pneumatic pressure as a power source by eliminating the need to bleed pressure in the control line or power fluid line a substantial amount. During pneumatic pump operation, for example, a compressor disposed at the surface may be cycled to change the pneumatic pressure in the control line or power fluid line by relative amounts to cause a pneumatically operated apparatus to function rather than bleeding the control line or power fluid line to ambient atmospheric pressure. In some embodiments, by incorporating a compressor with an accumulator, a storage bottle or bottle bank and pressure regulator, the compressor can simply be run intermittently to maintain the pressure in the accumulator, while using the pressurized gas in the accumulator to actuate the valve and associated pneumatically operated apparatus.

Figure 1:
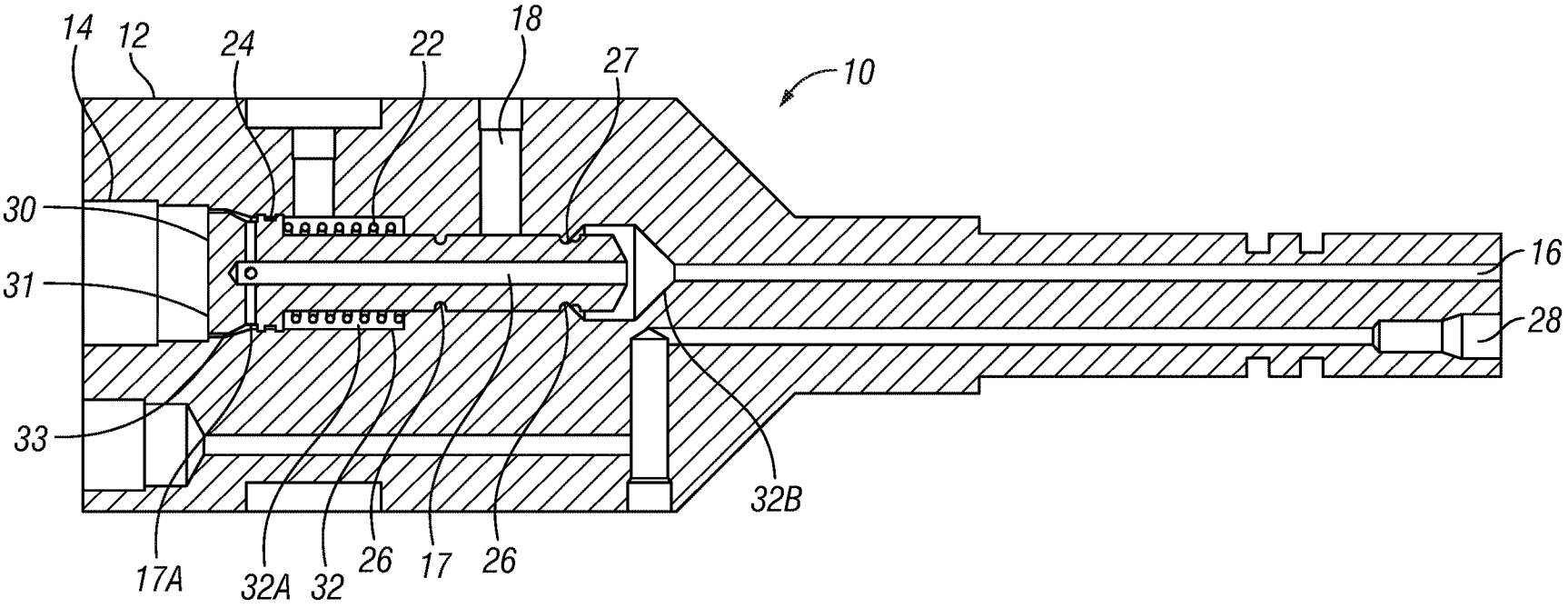
FIG. 1 shows a cross section of a valve according to the present disclosure.

FIG. 1 shows a cross-section of an example embodiment of a pressure operated device such as a valve according to the present disclosure. The valve 10 may be disposed in a valve body 12 having formed therein a power fluid inlet port 14. In the present example embodiment the power fluid may be, without limitation, any composition of compressed air or compressed gas (e.g., nitrogen or methane). A valve shuttle 30, which in the present embodiment may be elastomer coated metal is disposed in a shuttle bore 32 formed in the valve body 12. The shuttle 30 may comprise a piston 31 having a transverse flow port 17A connected to a longitudinal flow port 17 that extends through to the bottom end of the shuttle 30. A biasing device 22 such as a spring urges the shuttle 30 toward the power fluid inlet port 14. When the shuttle 30 is urged fully toward the power fluid inlet port 14, a seal surface 24 between the shuttle 30 and the shuttle bore 32 is closed and an opening 33 around the circumference of the piston 31 is exposed such that power fluid (i.e., compressed gas) is constrained to flow through the transverse flow port 17A and then into the longitudinal flow port 17. Annular seal elements, for example, o-rings 26 may be disposed on the exterior of the shuttle 30 such that the shuttle bore 32 is sealed between a chamber 32A wherein the spring 22 is disposed and a longitudinal end 32B of the shuttle bore 32. When the shuttle 30 is in such position as shown in FIG. 1, a seal surface 27 proximate the lower end of the shuttle 30 engages with the shuttle 30 such that no fluid flow may move from a power fluid flow port 16 in the valve body 12 to a power fluid vent port 18. Thus, when the shuttle 30 is urged fully toward the power fluid inlet port 14 by the spring 22, power fluid is constrained to flow through the valve 10 from the power fluid inlet port 14 to the power fluid flow port 16.

The power fluid flow port 16 may be in pressure communication with the power fluid inlet of a pneumatically operated device as will be explained with reference to FIG. 5. Thus with the valve 10 configured as shown in FIG. 1, power fluid flows through the shuttle 30 to a pneumatically operated device (FIG. 5) connected to the power fluid flow port 16.

The spring 22 has a rate selected to keep the shuttle 30 in the position shown in FIG. 1 as long as the pressure of the power fluid is less than a pressure such that power fluid force acting on the piston 31 is less than the force exerted in the opposite direction by the spring 22. When the power fluid pressure is so maintained, the power fluid will flow as explained above through the longitudinal flow port 17 in the shuttle 30 and into the power fluid flow port 16. The foregoing is shown in more detail in FIG. 2.

Figure 2:
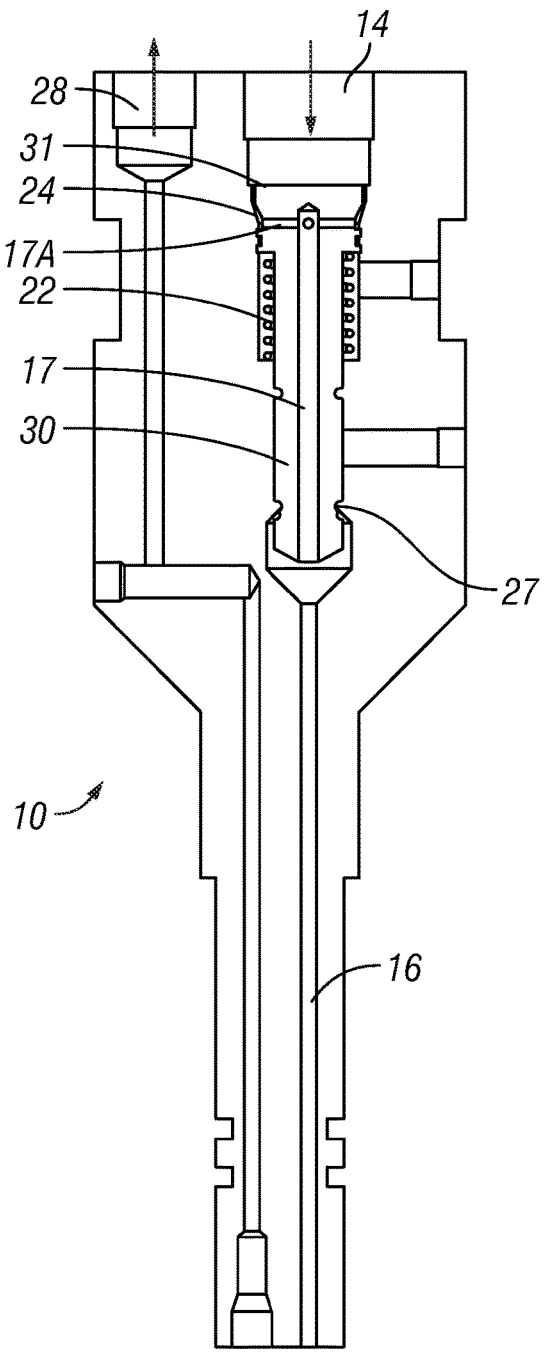
FIG. 2 shows the valve of FIG. 1 in the "flow through" position, wherein a pneumatically operated device is charged with pressurized gas from a power fluid line.

In the example embodiment of FIGS. 1 and 2, the valve body 12 may also comprise a fluid return passage or discharge port 28. Such discharge port, if provided, may be used, for example and as explained with reference to FIG. 5 to return pumped fluid to the surface.

Figure 3:
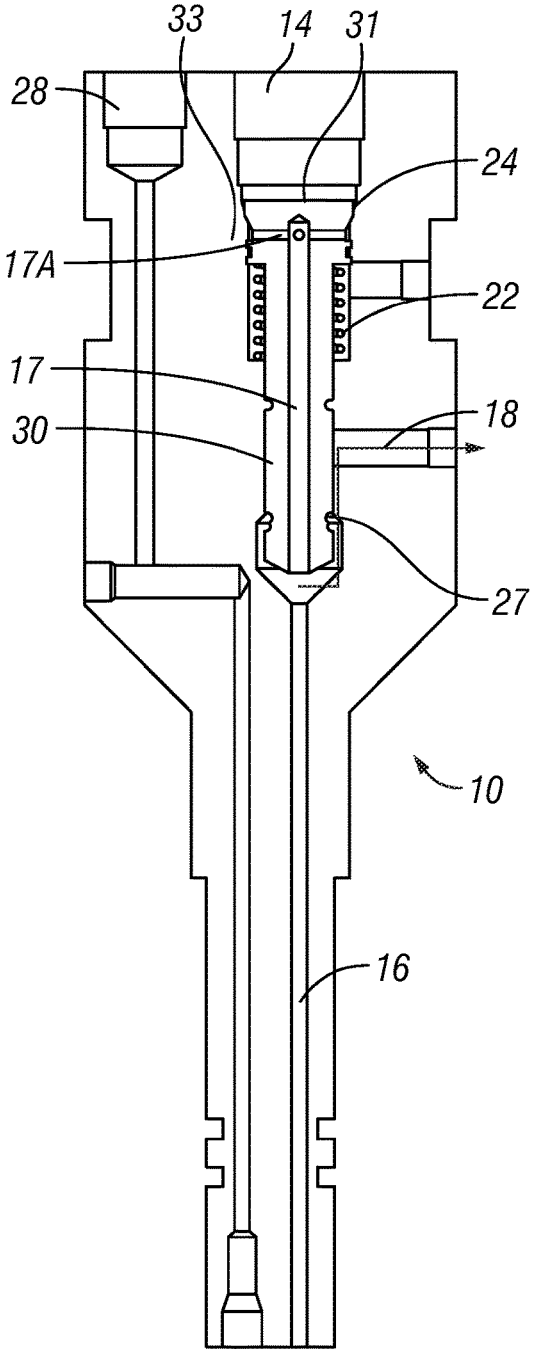
FIG. 3 shows the valve of FIG. 1 in the "bleed off" position, wherein pneumatic pressure used to operate the device is vented to a low pressure annulus in a wellbore while the power fluid line is closed to flow at its downhole end.

FIG. 3 shows the valve 10 configured to enable pressure in the power fluid flow port 16 to vent to ambient pressure in the wellbore (6 in FIG. 5) through a vent port 18. In FIG. 3, the pressure of the power fluid is increased such that the force acting on the piston 31 overcomes the force of the spring 22 to move the shuttle 30 toward the power fluid flow port 16. The shuttle 30 moves in such direction against the spring force until a seal 24 between the shuttle 30 and the opening 33 is activated. When the seal 24 is activated, the power fluid being pumped into the power fluid inlet port 14 is stopped at the seal 24 and thus can no longer flow through the transverse flow port 17A and the longitudinal flow port 17. At the same time, the seal surface 27 is disengaged from contact with the shuttle 30 as a result of movement of the shuttle 30 toward the power fluid flow port 16. With the seal surface 27 disengaged, pressurized power fluid in the device (FIG. 5) and in the power fluid flow port 16 may be vented to the ambient pressure in the wellbore (6 in FIG. 5). The device (FIG. 5) may thus be depressurized as part of its operating cycle, while pressure is maintained in the power fluid inlet port 14 and a power fluid flow line (2 in FIG. 5) connected to the power fluid inlet port 14.

The embodiment explained with reference to FIGS. 1 through 3 comprises a spring as the biasing device and wherein the chamber 32A is in fluid communication with ambient pressure in the wellbore, that is, external to the valve body 12. In other embodiments, the chamber 32A may be sealed, and gas may be maintained at a selected pressure in the chamber 32A, whereby the biasing device comprises a gas spring. Other embodiments of a biasing device will occur to those skilled in the art.

After the power fluid pressure in the device (FIG. 5) has been decreased to a selected amount, e.g., to the ambient pressure in the wellbore, the power fluid pressure applied to the power fluid inlet port 14 may be reduced, for example, by venting the power fluid to the atmosphere at the surface. The pressure in the power fluid inlet port may be reduced a limited amount, e.g., only as much as required until the spring 22 provides sufficient force to move the shuttle 30 to the position shown in FIGS. 1 and 2. With the shuttle returned to the position shown in FIGS. 1 and 2, power fluid may once again flow through the shuttle 30 (through the transverse flow port 17A and longitudinal 17 flow port) to recharge pressure in the device (FIG. 5). The foregoing pressurization and depressurization cycle may be repeated as required to keep the device (FIG. 5) in operation.

Figure 4:
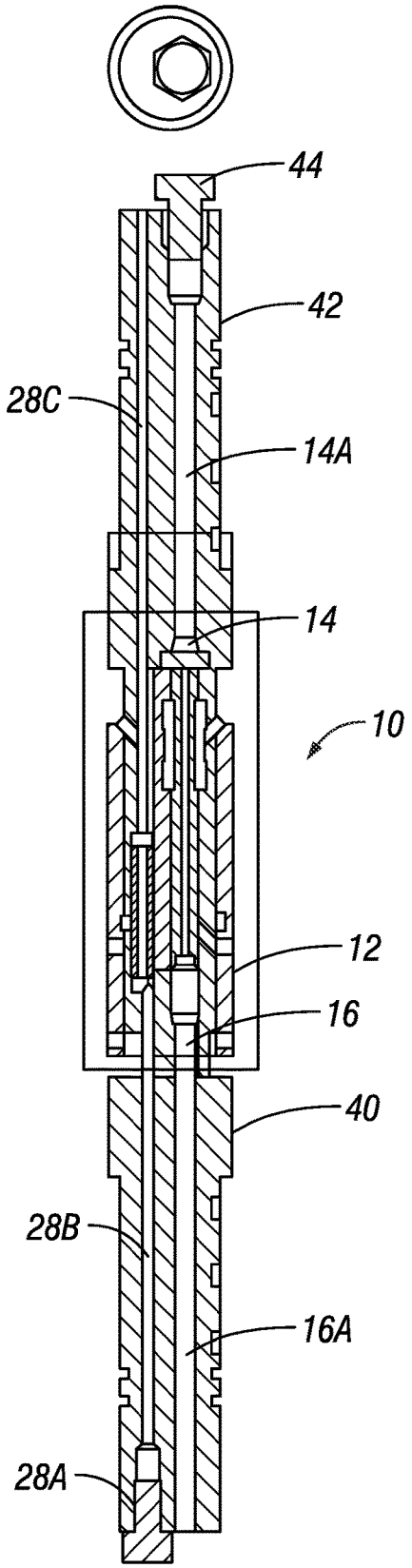
FIG. 4 shows the valve of FIG. 1 disposed in a coiled tubing connector.

FIG. 4 shows an embodiment of a valve according to the present disclosure configured for coupling within a coiled tubing. The valve 10 comprises a first roll on coiled tubing connector 40 coupled to the lower end of the valve body 12. Such coupling may be, for example, threaded connectors with or without set screws to reduce the possibility of unthreading, welding, hydraulic dimple connection, adhesive connection or any other suitable connection to enable transfer of axial load between the first roll on coiled tubing connector 40 and the valve body 12. A second roll on coiled tubing connector 42 may be coupled to an upper end of the valve body 12. An upper compression fitting 44 may make a pressure tight connection between a power fluid line (see 2 in FIG. 5) and a power fluid inlet passage 14A through the second roll on coiled tubing connector 42. The power fluid inlet passage is in pressure communication with the power fluid inlet port 14A in the valve body 12. The power fluid flow port 16 is in pressure communication with a power fluid flow passage 16A in the first roll on coiled tubing connector 40. A lower compression fitting 28A may sealingly couple a fluid return line (3 in FIG. 5) to a fluid return passage 28B in the first roll on coiled tubing connector 40. The fluid return passage is in pressure communication with the fluid return port 28 in the valve body 12. The fluid return port 28 may be in fluid communication with a return fluid passage 28C in the second roll on coiled tubing connector 42.

Figure 5:
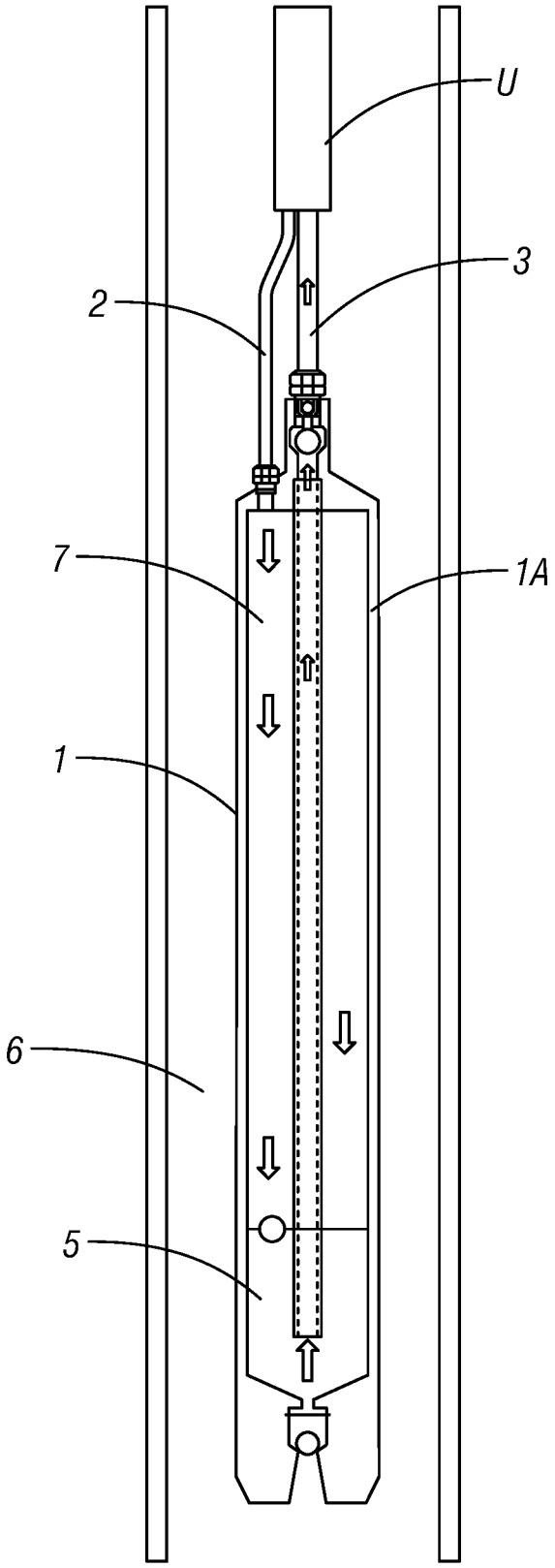
FIG. 5 illustrates a another embodiment of a submersible wellbore pump within a wellbore that is connected to a hydraulic power tube that may be routed to a surface hydraulic pressure supply providing high pressure air, gas or fluids. Arrows illustrate the gas, air and fluid transport direction.

FIG. 5 shows an example pneumatically operated apparatus connected to an umbilical line, such as a coiled tubing, wherein the coiled tubing comprises a power fluid line having a valve as explained above and a fluid return line to transport pumped fluid to the surface. In the present example embodiment, the pneumatically operated apparatus may comprise a wellbore pump 1 suspended within a wellbore 6. The wellbore pump 1 may be deployed in the wellbore 6 and suspended therein by an umbilical U. The umbilical U may comprise, for example, coiled tubing having therein a power fluid line 2 and a pumped fluid return line 3. The wellbore pump 1 may be connected to the power fluid line 2 that may be routed to a surface-deployed pressure supply providing power fluid 7 in the form of pneumatic pressure. The power fluid line 2 may comprise therein a valve as explained with reference to FIGS. 1 through 4. The pumped fluid return line 3 may be used to transport wellbore fluids 5 to the surface. The power fluid 7 may be used to evacuate the wellbore fluids 5 that may be trapped in the pump housing 1A by pushing the wellbore fluids 5 out through an exhaust tube 8 disposed in the interior of the pump housing 1A, wherein the exhaust tube 8 may be hydraulically connected to the pumped fluid return line 3. Arrows illustrate the power fluid 7 and wellbore fluid 5 transport direction. As the pump housing 1A has wellbore fluid (5) displaced by power fluid (7), a check valve 10 may prevent escape of fluid within the pump housing 1A through the pump intake 1B. The wellbore pump 1 may be operated by repeatedly increasing and decreasing the pressure of the power fluid 7. As explained with reference to FIGS. 1 through 4, the power fluid pressure between the valve and the wellbore pump may be increased and decreased by operating the valve, thereby enabling the power fluid line from the valve to the surface to remain substantially charged with gas at a pressure proximate the operating pressure of the wellbore pump 1.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A pressure operated wellbore valve, comprising:

a valve body having a bore therein for a shuttle, the shuttle comprising a piston having a longitudinal flow port for a power fluid to move through the shuttle longitudinally, the valve body comprising a power fluid inlet port at one longitudinal end and a power fluid flow port at another longitudinal end;

a biasing device disposed in a chamber on one side of the shuttle; and wherein the shuttle comprises a first seal proximate the power fluid inlet port in the valve body such that when the biasing device urges the shuttle to one end of the bore, the power fluid is in communication between the power fluid inlet and the power fluid flow port, and wherein when a pressure of the power fluid at the power fluid inlet port urges the shuttle away from the power fluid inlet port, the first seal stops flow of the power fluid through the shuttle, and wherein a second seal between the shuttle and the bore is opened such that a flow path between the power fluid flow port and the exterior of the valve body is opened.

2. The valve of claim 1 wherein the shuttle comprises elastomer covered metal.

3. The valve of claim 1 wherein a rate of the biasing device is selected to enable movement of the shuttle at a selected pressure.

4. The valve of claim 1 wherein at least one of the first seal and the second seal comprises a metal to metal seal.

5. The valve of claim 1 further comprising a coiled tubing connector disposed at at least one end of the valve body.

6. The valve of claim 1 further comprising a return flow passage formed longitudinally through the valve body.

7. The valve of claim 1 wherein the biasing device comprises a spring.

8. The valve of claim 7 wherein the chamber is in pressure communication with an exterior of the valve body.

9. A method for operating a pneumatic device in a wellbore, comprising:

conducting pressurized gas to a power fluid inlet port of a valve at a first pressure, the first pressure selected to cause a shuttle in the valve to be positioned to enable flow of the pressurized gas through the valve to a power fluid flow port in communication with a power fluid inlet of the pneumatic device; and increasing pressure of the pressurized gas to a second pressure greater than the first pressure, whereby the shuttle moves to close the power fluid inlet port to flow and to vent the power fluid flow port to ambient pressure in the wellbore.

10. The method of claim 9 further comprising reducing pressure of the pressurized gas to the first pressure to reenable flow of the pressurized gas through the valve to the power fluid flow port in communication with the power fluid inlet of the pneumatic device.

11. The method of claim 9 wherein the pneumatic device comprises a wellbore fluid pump.

* * * * *